United States Patent [19]

Fina

[11] Patent Number: 5,070,785

[45] Date of Patent: Dec. 10, 1991

[54] DEVICE FOR TENSIONING PRINTING PLATES MOUNTED ON A CYLINDER OF AN INTAGLIO PRINTING MACHINE

[75] Inventor: Raffaele Fina, Lausanne, Switzerland

[73] Assignee: De La Rue Giori S.A., Lausanne, Switzerland

[21] Appl. No.: 531,258

[22] Filed: May 31, 1990

[30] Foreign Application Priority Data

Jun. 14, 1989 [CH] Switzerland ..... 2233/89

[51] Int. Cl.[5] ..... B41F 1/28

[52] U.S. Cl. ..... 101/415.1; 29/119

[58] Field of Search ..... 101/415.1, 378, 409, 101/127.1, 382.1, 383; 29/118, 119

[56] References Cited

U.S. PATENT DOCUMENTS

| | | | |
|---|---|---|---|
| 1,860,765 | 5/1932 | Baldwin | 101/415.1 |
| 2,005,885 | 6/1935 | Brindley | 29/119 |
| 2,538,499 | 1/1951 | Benoit | 29/119 X |
| 3,016,010 | 1/1962 | Luehrs | 101/415.1 |
| 3,141,405 | 7/1964 | Tombeur | 101/415.1 |
| 3,434,415 | 3/1969 | Ishii | 101/415.1 |
| 3,456,588 | 7/1969 | Brodie | 101/415.1 |
| 4,237,592 | 12/1980 | Kuge et al. | 29/119 |
| 4,864,704 | 9/1989 | Hogan et al. | 29/119 |

FOREIGN PATENT DOCUMENTS

| | | | |
|---|---|---|---|
| 1304 | of 1913 | United Kingdom | 29/119 |

*Primary Examiner*—Eugene H. Eickholt
*Attorney, Agent, or Firm*—Kane Dalsimer Sullivan Kurucz Levy Eisele and Richard

[57] ABSTRACT

In order to apply opposite axial forces to the lateral edges of each intaglio printing plate mounted on a plate cylinder or on a sleeve, the cylinder (1) is provided at its two lateral sides and for each lateral edge of each printing plate with an annular sector (5, 6, 7). These sectors have the same external diameter as the cylinder and are provided with screws (23) for attaching the lateral edges of each printing plate (2, 3, 4) thereto, with screws (16) in order to be mounted on the lateral sides of the cylinder (1) so as to be displaceable axially and with other screws (25) which are screwed into the sectors (5, 6, 7) and which abut the cylinder (1). Using these screws (25) and by way of the pressure which they exert against the cylinder, each printing plate may be positioned and tensioned axially. Furthermore, helical springs (19) are provided which apply compressive forces tending to move apart said annular sectors (5, 6, 7) of the cylinder (1) axially, and therefore to apply tensile forces in a permanent manner to the lateral edges of each printing plate.

In the case of a single printing plate, said sector is closed and forms a ring.

7 Claims, 1 Drawing Sheet

DEVICE FOR TENSIONING PRINTING PLATES MOUNTED ON A CYLINDER OF AN INTAGLIO PRINTING MACHINE

FIELD OF THE INVENTION

The present invention relates to a device for tensioning printing plates mounted on a cylinder formed by a sleeve or a plate cylinder of an intaglio printing machine.

PRIOR ART

In the field of printing, the term "plate cylinder" is understood to mean the unit consisting of the body of the cylinder which carries printing plates and the shaft with which this body of the cylinder is integral, and the term "sleeve" is understood to mean simply the tube or the cylindrical shell without the shaft. Plate cylinders are generally used in sheet-fed printing machines and must be installed as a unit in the bearings of the machine, and disassembled completely from the machine, respectively, by removing the shaft from the bearings, while the sleeves, used generally in web-fed printing machines, may simply be mounted on the shaft, and disassembled from their shaft, respectively, the printing plates being mounted on the sleeve before it is mounted on the shaft.

Since the present invention refers to both plate cylinders and sleeves, it has been agreed to use the term "cylinder" in order to define both when they are referred to in a general manner in the description and in the claims.

For intaglio printing, this cylinder which carries the plates must meet certain very strict requirements which guarantee, on the one hand, the sharpness of the printing and, on the other hand, perfect register between the various images.

In the case of plate cylinders on which printing plates are fixed individually on sectors of the cylinder which are separated by trenches, it is known to use fixing and adjusting elements which are housed in the trenches and to which the ends of the plates which project inside these trenches are attached. After having attached the plates to the elements, the latter are displaced in the peripheral direction in order to tension the plates perfectly in the peripheral direction. Such known devices for tensioning employ either mechanical means (U.S. Pat. No. 2,837,025) or hydraulic means (U.S. Pat. No. 4,596,188 and U.S. Pat. No. 4,598,642).

These known methods and devices always refer to various means for tensioning the plates in the peripheral direction.

Against this background, the Applicant has proposed a still more practical and advantageous method which forms the subject of a parallel patent application filed in Switzerland under No. 2232/89-0 on the same day as the present application and which enables the plates to be placed and tensioned end-to-end; this method and this installation may be applied to plate cylinders proper as well as to sleeves having a continuous peripheral surface. This tensioning in the peripheral direction is effected by a set of wedges arranged in grooves cut into the cylinder. This method which has been mentioned is an attractive alternative and is more advantageous when compared with plate sleeves on which the plates are fixed by adhesive bonding, as has been described, for example, in patents U.S. Pat. No. 4,224,095 or U.S. Pat. No. 4,680,067. These adhesive bonding methods which do not require a large number of method steps are expensive.

The known methods which have been mentioned for tensioning the plates in the peripheral direction and which are entirely satisfactory for this peripheral tensioning do not, however, allow the printing plates to be prevented from being deformed under the action of tensile forces in the peripheral direction and under the action of the compressive forces to which they are subjected during printing.

SUMMARY OF THE INVENTION

The present invention proposes a device which complements the known devices, enabling intaglio printing plates to be fixed and also tensioned axially on a plate cylinder or on a sleeve, preventing any deformation as a result of the abovementioned causes.

In order to achieve this object, the method according to the invention is defined in that the cylinder is provided at the two lateral sides with means for applying opposite axial forces to the lateral edges of each printing plate, said means comprising, for each lateral edge of each printing plate, an annular sector, in the case of a single printing plate said sector being closed and forming a ring, these sectors have the same external diameter as the cylinder and are provided with means in order to attach the lateral edges of each printing plate thereto and in order to be mounted on the lateral sides of the cylinder so as to be displaceable axially in order to apply tensile forces to the lateral edges of each printing plate in the axial direction.

The advantages of this device are as follows: by fixing the lateral ends of the printing plates mounted on a cylinder onto annular sectors arranged on either side of the lateral sides of the cylinder, on the one hand a better retention of the printing plates is ensured and, on the other hand, axial tension is applied to the plates, enabling the very disadvantages mentioned above to be counteracted, namely the deformation of the plates mounted by means applying peripheral tensile forces, and the deformations which may occur during printing as a result of the high contact pressure.

Elastic means may preferably be provided between the annular sectors and the lateral sides of the cylinder, these elastic means applying compressive forces tending to move apart the annular sectors of the cylinder axially. These elastic means, which are in particular formed by helical springs, serve to maintain the axial tension of the printing plates while the printing machine is functioning if a certain expansion of the plates occurs as a result of the deformations mentioned.

The device according to the invention may be used for fixing intaglio plates onto both a sleeve, and therefore generally for web-fed printing, and onto a plate cylinder, and therefore generally for sheet-fed printing.

Although in the above text we have always referred to plates in the plural, the invention also refers to the case where the cylinder is intended to carry a single plate.

Preferred embodiments of the device emerge from the dependent claims.

BRIEF DESCRIPTION OF THE DRAWINGS

The invention will be described in more detail with reference to the attached drawings.

DESCRIPTION OF THE PREFERRED EMBODIMENT

Figure 1:
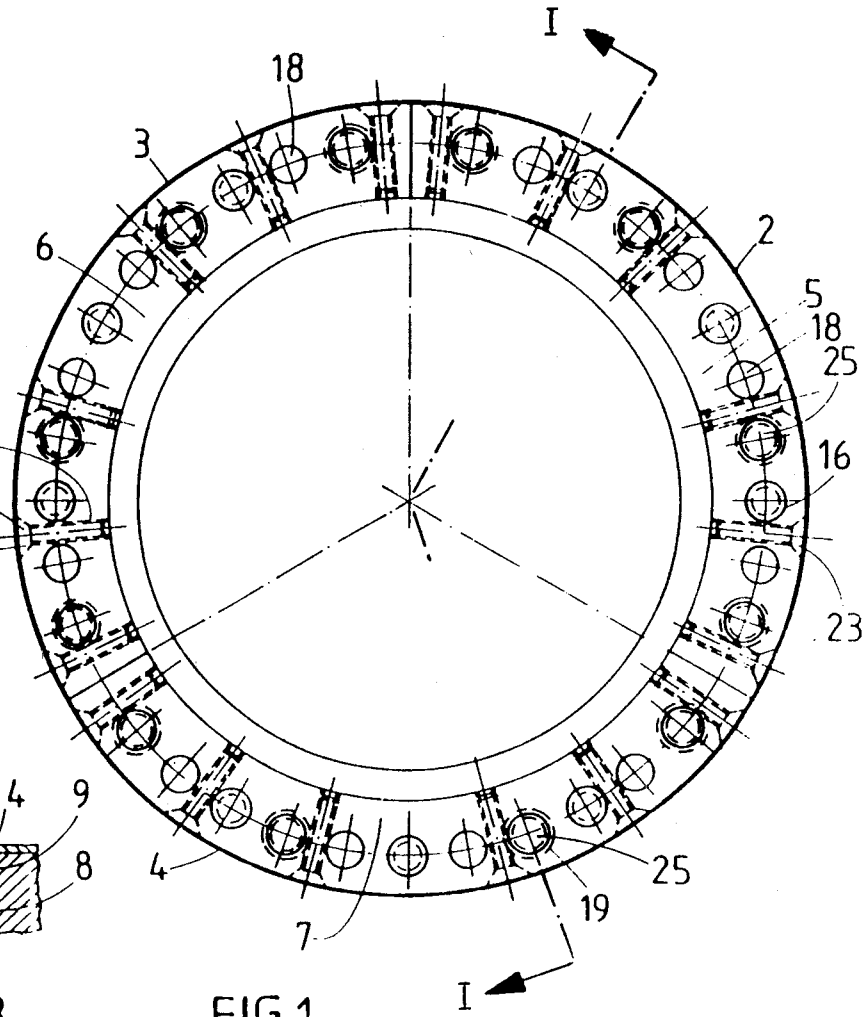
FIG. 1 is a lateral view of a sleeve provided with a device according to the invention.
Figure 2:
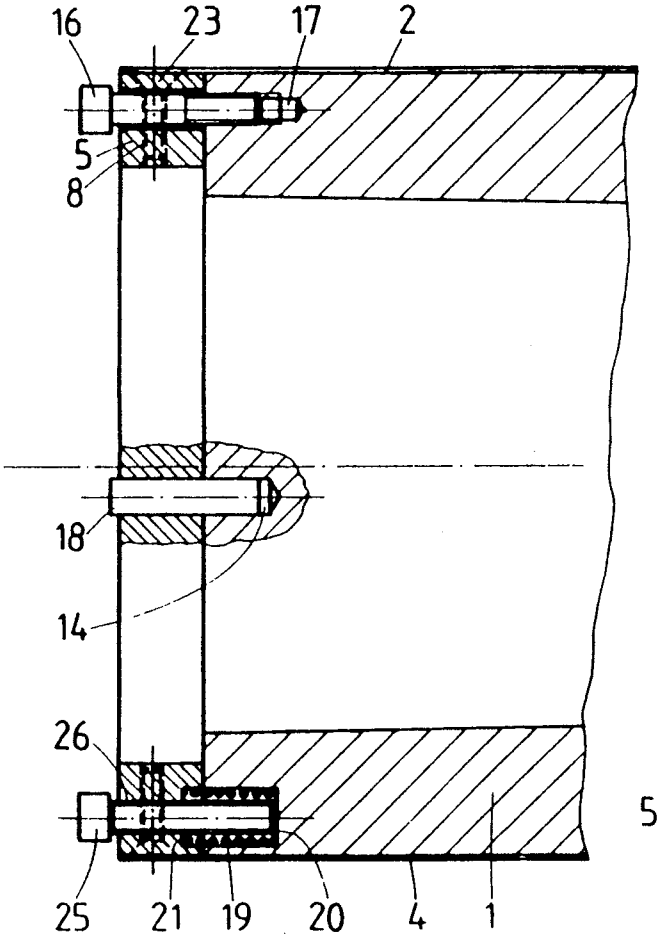
FIG. 2 is a partial view in cross-section along the line I—I in FIG. 1, showing the end of this sleeve.

FIGS. 1 and 2 show a plate sleeve 1 on which three printing plates 2, 3, 4 are mounted, secured and tensioned in the peripheral direction such that the adjacent ends of each plate are situated edge-to-edge in order to form a continuous surface. The fixing and the tensioning of these plates in the peripheral direction is performed by known or proposed means such as, for example, those described in the introduction.

The sleeve 1 is provided on either side with three annular sectors 5, 6, 7 with the same diameter as it, and which are situated in the extension of its lateral faces, one sector for each lateral edge of each plate 2, 3, 4. During the mounting of the printing plates 2, 3, 4, the lateral edges of the latter are fixed onto said sectors as described below. Each sector 5, 6, 7 is mounted axially on the sleeve 1 by regularly distributed screws 16 which are screwed into blind and tapped axial housings 17 in the side of the sleeve 1, while they pass freely through the sectors 5, 6, 7 such that each sector 5, 6, 7 can be displaced axially relative to the sleeve 1. The tension in the radial direction and the guiding of the sectors are ensured by regularly distributed guides 18 formed by pins driven into blind axial passages 14 on the sleeve 1, their size enabling them to slide in holes provided in each sector 5, 6, 7.

Screws 25 for positioning and tensioning the plates laterally are arranged alternately with the screws 16 and the guides 18. These screws 25 are screwed only onto the sectors 5, 6, 7 in axial tapped passages 26 in the latter, and penetrate into blind and opposite housings 20 and 21 which extend axially, on the one hand, on the sleeve 1 and, on the other hand, in the sectors 5, 6, 7 facing the sleeve. These screws 25 abut the base of the housings 20, enable the printing plates to be positioned axially and the axial tension applied to the latter to be adjusted via said annular sectors. Helical springs 19 surrounding the screws 25 and bearing against the base of the housings 20 and 21 are housed in these blind housings 20, 21. These springs, when compressed, ensure a constant force in the axial direction, therefore pressing the sectors outwards, the maximum clearance which may be obtained by these springs being limited by the position of the screws 16. The screws 16 allow the springs 19 to be compressed during the mounting or disassembly of the plates.

Figure 3:
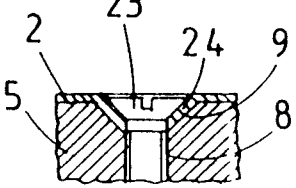
FIG. 3 is an enlarged detailed view of a countersink on the plate.

In order to fix the printing plates 2, 3, 4 onto the annular sectors 5, 6, 7, the latter have, over their peripheral circumference, radially pierced tapped holes 8, the upper part 9 of which is conical and into which screws 23 with milled heads can be screwed. The lateral ends of the printing plates 2, 3, 4 situated level with the sectors 5, 6, 7 have countersinks 24 which take their place in the conical parts 9 of the holes 8. The term countersink is understood to mean a shape which has been stamped in the plate serving as a housing for the head of the screws which thus do not project from the plate, as illustrated in FIG. 3.

During the positioning of the printing plates 2, 3 and 4, the screws 16 are tightened in order to compress the springs 19. After the plate has been fixed via the screws 23, the screws 16 are loosened slightly such that the sectors 5, 6, 7 may yield under the action of the helical springs 19 which may thus act in traction on the plate. Thus, in addition to the clamping of the plates in the peripheral direction by means of any known method, a force in the axial direction of the sleeve is also ensured by means of the springs 19, enabling the axial shrinkage to which the printing plates could be subject to be counteracted and preventing a localized momentary deformation during printing.

Similarly, in order to facilitate the disassembly of the plate when it is desired to change it, these screws 16 are tightened again in order to compress the springs 19.

If, after the printing machine has been functioning for a reasonably long period of time, the printing plates have undergone, because of the deformations mentioned, an expansion such that under the force of the helical springs exerting a permanent tension on the plates the screws 25 no longer abut the base of the housings 20, all the screws 25 are tightened again after the machine has come to a standstill in order to recover the play.

It is also possible to dispense with the helical springs 19 and, after the machine has been functioning for a certain time, if it proves necessary, the axial tension of the plates may be readjusted by retightening the screws 25.

If a cylinder has been provided with a single plate, under these conditions a closed annular sector, in other words a ring, may be used for each lateral edge of the plate.

The device according to the invention applies as an additional tensioning means for all installations which enable the plates to be fixed and tensioned in the peripheral direction, with the exception, of course, of the sleeves to which the plates are adhesively bonded.

The invention is not limited to the embodiments described but also covers numerous possible alternatives. In particular, the invention also applies to plate cylinders having cylinder sectors separated by trenches where individual plates are fixed and adjusted on the sectors of the cylinder.

I claim:

1. A device for tensioning one or more printing plates (2, 3, 4) mounted on a plate cylinder of an intaglio printing machine, in which said cylinder (1) is provided at two lateral sides with means for applying opposite axial forces to the lateral edges of each printing plate (2, 3, 4), said means comprising, for each lateral edge of each printing plate, at least one annular sector (5, 6, 7), said means being closed and forming a ring each said section having the same external diameter as said cylinder and being provided with means for attaching said lateral edges of each printing plate (2, 3, 4) thereto for mounting on the lateral sides of the cylinder (1) so as to be displaceable axially to apply tensile forces to the lateral edges of each printing plate in the axial direction.

2. The device as claimed in claim 1, in which said annular sectors (5, 6, 7) are mounted on the sides of the cylinder (1) by screws (16) which are screwed axially onto the cylinder and pass freely through the annular sectors in order to hold them in place axially in the absence of printing plates, and in which said annular sectors are guided axially by axial pins (18) and in which screws (25) are provided which are screwed onto these annular sectors and abut the cylinder to enable the printing plates to be positioned axially and the axial tension applied to the latter to be adjusted via said annular sectors.

3. The device as claimed in claim 2, in which elastic means are provided between said annular sectors (5, 6, 7), and the lateral sides of the cylinder (1), these elastic means applying compressive forces tending to move apart said annular sectors (5, 6, 7) of the cylinder (1) axially.

4. The device as claimed in claim 3, in which said screws (16) which are screwed axially onto the cylinder (1) and pass freely through the annular sectors (5, 6, 7) to compress said elastic means when the printing plates are mounted.

5. The device as claimed in claims 3 or 4, in which the elastic means are helical springs (19).

6. The device as claimed in claim 5, in which said helical springs (19) surround said screws (25) which are screwed onto the annular sectors, and are housed in housings (20) provided in the cylinder and into which these screws (25) penetrate.

7. The device as claimed in claim 1, in which the means for attaching the lateral edge of each printing plate (2, 3, 4) to the annular sectors (5, 6, 7) are screws (23) penetrating into tapped holes (8) on the sectors and the head of which screws is housed in countersinks (24) formed in said plates.

* * * * *